United States Patent [19]

Kucher et al.

[11] 4,363,702

[45] Dec. 14, 1982

[54] APPARATUS FOR RECEIVING INCANDESCENT COKE

[76] Inventors: Valery N. Kucher, ulitsa 9 Maya, 15 kv. 25; Georgy R. Reiman, ulitsa Syrovtsa, 2/28 kv. 79; Grigory D. Zhovtobrjukh, Komsomolsky prospekt 20, kv. 40, all of Dneprodzerzhinsk; Evgeny P. Likhogub, ulitsa Slinko, 2a, kv. 11; Gersh A. Dorfman, ulitsa 23 Avgusta, 31a, kv. 52, both of Kharkov; Mikhail I. Durachenko, ulitsa Lesopilnaya, 1/28, kv. 32, Dneprodzerzhinsk; Alexandr N. Minasov, ulitsa Ivanova, 12/16 kv. 59, Kharkov; Valentin B. Bocharov, ulitsa Boiko 41 kv. 72; Alexandr Z. Popenko, ulitsa Prigorodnaya 68, both of Dneprodzerzhinsk, all of U.S.S.R.

[21] Appl. No.: 247,299

[22] PCT Filed: Jul. 31, 1979

[86] PCT No.: PCT/SU79/00062

§ 371 Date: Mar. 31, 1981

§ 102(e) Date: Mar. 26, 1981

[87] PCT Pub. No.: WO81/00414

PCT Pub. Date: Feb. 19, 1981

[51] Int. Cl.[3] ..... B61D 7/12; B61D 7/18; B61D 7/22; C10B 39/14

[52] U.S. Cl. ..... 202/262; 105/250; 105/254; 202/268; 202/269

[58] Field of Search ..... 202/262, 268, 266, 269, 202/227, 228; 105/424, 254, 250, 247, 255

[56] References Cited

U.S. PATENT DOCUMENTS 1,697,475 1/1929 Pinder ..... 105/254
3,970,526 7/1976 Bender ..... 105/254

FOREIGN PATENT DOCUMENTS 969548 6/1958 Fed. Rep. of Germany ..... 105/255

OTHER PUBLICATIONS

"Dry Quenching of Coke;" Metallurgiya (Publishers); p. 53; 1971.

"Moderization of Cars for Carrying Incandescent Coke at Dry-Quenching Plants;" Koks Ikhimiya; No. 4; p. 41; 1975.

*Primary Examiner*—Bradley Garris
*Attorney, Agent, or Firm*—Steinberg & Raskin

[57] ABSTRACT

To decrease a loss of coke due to burning and to prolong the service life of an apparatus for receiving incandescent coke and conveying the same to a quenching tower, between a wall structure (1) and lining plates (2) there is disposed a spacing member in the form of corrugated sheets (12), and the lining plates (2) are mounted with the provision for linear expansion under the action of heat from incandescent coke and connected to the wall structure (1) by means of cover pieces (13) overlapping temperature gaps, bolts (14) and nuts (15). Bottom gates (7) of a hopper (5) are provided with sealing members (18) having a surface (A) and (B) contacting the round surface of a girdle (6) tangentially. Specific embodiments of spacing members, sealing members and locking means are described.

7 Claims, 13 Drawing Figures

APPARATUS FOR RECEIVING INCANDESCENT COKE

TECHNICAL FIELD

The present invention relates to the processing equipment employed in the production of coke and is specifically concerned with an apparatus for receiving incandescent coke and then carrying the same from a coking chamber to a quenching site. The invention may prove most advantageous at the coking plants where the dry coke-quenching technique is used.

BACKGROUND ART

At coking plants, incandescent coke is conveyed from a coking chamber to a quenching site mainly in cars adapted to travel along a rail track (Tep/litskiy N. G. et al. Sukhoe tushenie koksa (Dry quenching of coke), "Metallurgiya" Publishers, Moscow, 1971, p. 53). Such cars comprise a carriage and an apparatus for receiving incandescent coke removably mounted on the carriage. The apparatus for receiving incandescent coke includes a wall structure which is a truss framework and lining plates mounted on the supporting members of the truss framework. Employed for lining the wall structure are either rolled nickeliferrous-steel plates or cast heat-resistant iron plates. The lining plates are installed with the provision for their linear expansion, i.e. with a gap or clearance to ensure such an expansion (Kostin N. P., Lichinskiy A. P., Modernizatsiya vagonov dlya perevozki raskalyonnogo koksa ustanovok sukhogo tushenia, i.e., Modernization of cars for conveying incandescent coke at dry-quenching plants, "Koks i khimiya" Publishers, 1975, No. 4, p. 41). A convenient apparatus for receiving incandescent coke comprises also a hopper defined by the bottom portion of the wall structure, which hopper has a discharge hole and is framed adjacent to said hole by a girdle. To close said discharge hole, the hopper is provided with bottom gates which normally abut against the girdle.

In prior art apparatus, an active combustion of coke takes place during its loading and transportation, leading to a loss of coke and to a rapid heating of the lining plates and the wall structure, which results in a premature deterioration of the latter. The burning is caused by air draught or inleakage through the gaps between the lining plates.

In addition, in manufacturing the apparatus it is difficult to avoid an unstraightness of the girdle surfaces abutting on the bottom gates, which results in development of gaps in the zone of abutment of the girdle on the gates; the gaps are further increased in the course of service due to a thermal warpage of the girdle, which additionally promotes the air draught or inleakage through the gaps.

DISCLOSURE OF INVENTION

The present invention has for its object to provide an apparatus for receiving incandescent coke, wherein the coke loss by burning is cut down and the maximum protection of the wall structure of the apparatus from the thermal effect of incandescent coke is ensured by means of eliminating the gaps between the lining plates and in the zone of abutment of the bottom gates to the discharge hole.

This object is attained by the provision of an apparatus for receiving incandescent coke and conveying the same from a coking chamber to a quenching site, comprising a wall structure which is lined with plates of a suitable material, installed so as to provide for a linear expansion thereof, and defines at its bottom portion a hopper having a discharge hole and framed adjacent to the discharge hole by a girdle, and bottom gates to close said discharge hole, wherein, according to the invention, the wall structure and the lining plates are installed in a spaced relationship to define a gap therebetween, the lining plates are joined with one another and with the wall structure by locking means and spacing members, the girdle is round in cross-section, and the bottom gates are provided with sealing members having at least one sealing surface disposed so that, with the bottom gates in the closed position, it contacts the girdle tangentially.

Such an apparatus enables the coke loss by burning to be cut down owing to elimination of the gaps between the lining plates and in the zone of abutment of the bottom gates to the discharge hole, which is attained with the aid of the locking means mainly within the space defined by the lining plates; with the aid of the spacing members, outside said space; and with the aid of the sealing members, in the zone of abutment of the bottom gate to the hopper girdle. Moreover, eliminating the gaps and interposing the spacing members between the lining plates and the wall structure improves the thermal conditions of the wall structure in operation of the apparatus, thereby reducing the thermal warpage and extending the service life of the structure.

Interposing a corrugated sheet as the spacing member between the lining plates and the wall structure promotes the heat transfer from the lining plates, thereby enhancing their durability and additionally reducing the heating of the wall structure.

For best results, the corrugated sheets are preferably installed so that their ends overlap each other at the joint. The spacing member may also have a through-shaped cross-section; this may be, e.g., a bent sheet or a rolled section.

In accordance with one aspect of the invention, the lining plates may be installed in a spaced relationship so as to define a gap therebetween, and to prevent air inleakage, each locking means is preferably made up of a cover piece and a bolt holding the cover piece on the lining plates at the gap therebetween, extending between the adjacent lining plates and through the wall structure, and axially locked from an axial displacement by a nut.

The spacing member and the locking means may be combined so that the spacing member is integral with the bolt and has an end face or a shoulder whereupon a lining plate is supported.

In accordance with another aspect of the invention, the lining plates may be installed in an overlapping relationship; in this case, each locking means may preferably have the form of a hook secured to a lining plate and holding the plate in position with respect to the wall structure.

BRIEF DESCRIPTION OF DRAWINGS

The exact nature of the invention will be clear from the following detailed description thereof with reference to the accompanying drawings, wherein.

BEST MODE OF CARRYING OUT THE INVENTION

Figure 1:
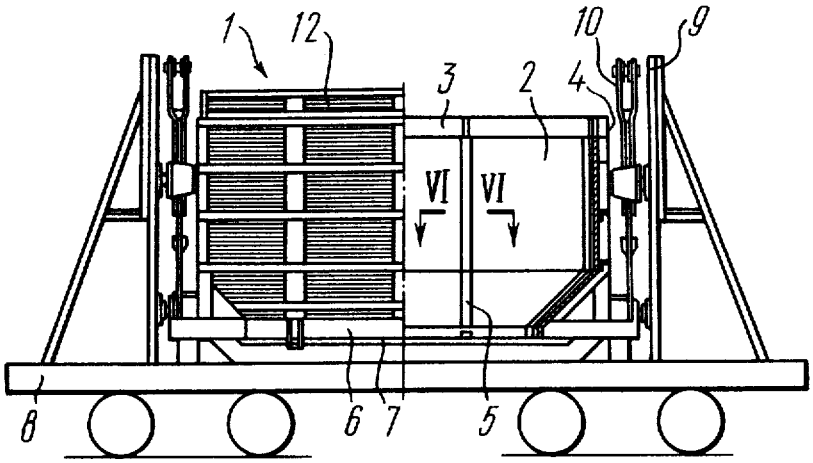
FIG. 1 is a diagrammatic view of an apparatus of the invention mounted on a carriage, a part of the side wall structure and of the lining plates being shown.
Figure 2:
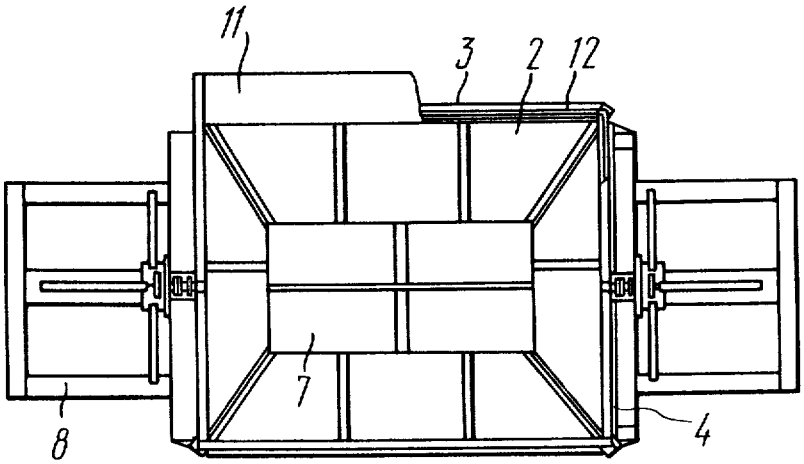
FIG. 2 is a top view of the apparatus illustrated in FIG. 1.

Referring to FIG. 1, the apparatus of the present invention comprises a wall structure 1 lined with plates 2 of a suitable material, such as a heat-resistant cast iron or heat-resistant steel. Such a wall structure generally includes side wall structures 3 and end wall structures 4. Also, the wall structure 1 defines at the bottom portion thereof a hopper 5 having a discharge hole and framed adjacent to the discharge hole with a girdle 6, as will be best seen in FIG. 3. The hopper 5 is provided with bottom gates 7 serving to close the discharge hole in loading and to pass out the material in unloading. The wall structure 1 jointly with the hopper portion defines the space for receiving incandescent coke and conveying the same from a coking chamber to a quenching site, for which purpose in this illustrative example the apparatus of the invention is placed onto a carriage 8 intended for travel on a track. The apparatus is also equipped with conventional means for lifting the entire apparatus, such means as guides 9 and pull rods 10, and the wall structure 1 also defines a coke-receiving chute 11. To provide for linear expansion under the action of heat from incandescent coke, the plates 2 are mounted with the provision for such an expansion, the specific examples of installation of the plates being described hereinafter.

In accordance with the present invention the wall structure 1 and the lining plates 2 are installed in a spaced relationship to define a gap therebetween, which is attained with the use of spacing members, such as corrugated sheets 12. As will be seen in FIGS. 1, 2, 4–6, and 9 of the accompanying drawings (in FIGS. 3 and 10–13, the spacing members are not shown for simplicity of representation), the corrugated sheets 12 are interposed between the wall structure 1 and the lining plates 2, the ends of the corrugated sheets overlapping at the joints. FIGS. 1, 2, 4–7, and 9 show that the corrugated sheets 12 are installed in a spaced relationship to define a gap therebetween; with this arrangement, it is expedient to fasten the lining plates 2 to the wall structure 1 with the use of a locking means comprising a cover piece 13 and a bolt 14 holding the cover piece 13 on the lining plates 2 at the gap therebetween. As will be seen in the drawings, and more specifically in FIG. 6, the bolt 14 extends between the adjacent lining plates 2 through the corrugated sheet 12 and further through the wall structure 1. To prevent the bolt 14 from an axial displacement, the entire assembly is held by a nut 15. This arrangement makes thus possible the linear expansion of the lining plates 2, ensuring at the same time an adequate tightness of the joint.

Figure 3:
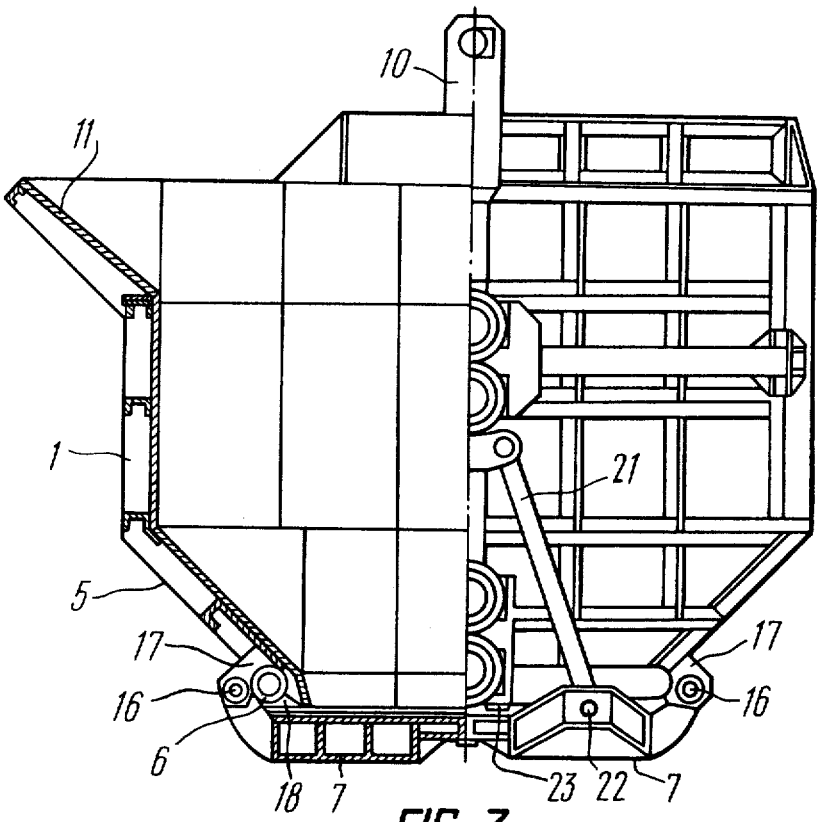
FIG. 3 is a diagrammatic representation of the apparatus of the invention as viewed on the end wall structure, a part of the end wall structure being removed to show the components of the bottom gate.
Figure 10:
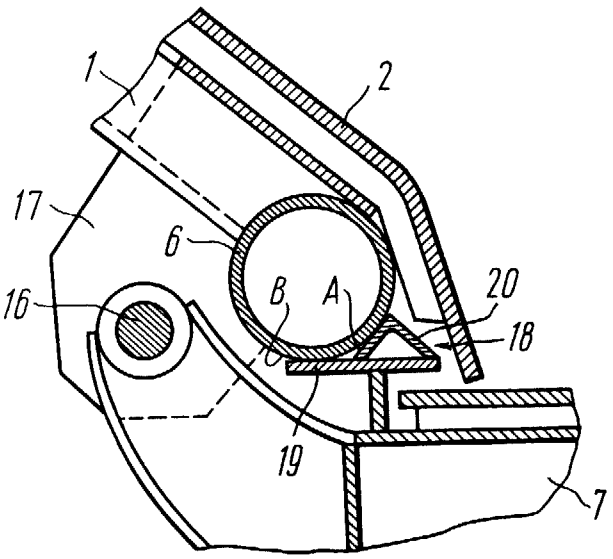
FIG. 10 is a detailed diagrammatic view showing the region of abutment of the bottom gate on the hopper girdle.
Figure 13:
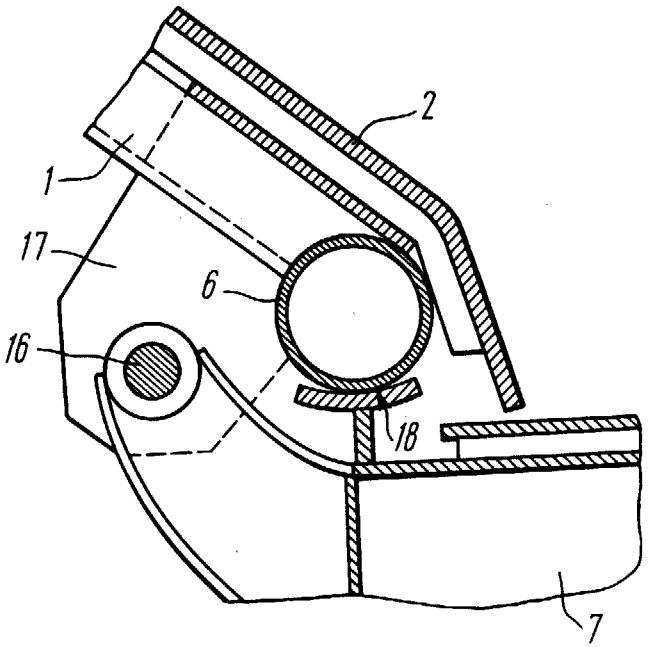
Figure 12:
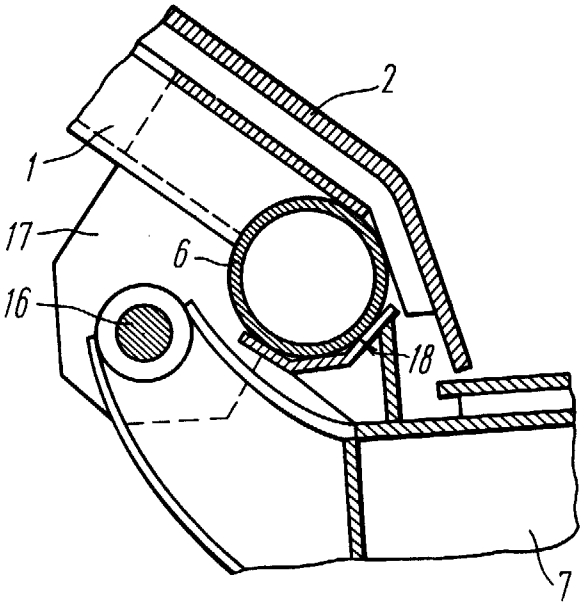

As shown in FIG. 3 and in greater detail in FIG. 10, the girdle 6 of the hopper 5 is of a round cross-section; this embodiment of the invention comprises the girdle 6 fabricated from an appropriate tubing, and the bottom gates 7 are weldments turnable around hinge pins 16 in hinges 17 secured to the wall structure 1 adjacent to the discharge hole of the hopper 15. It will be apparent to those skilled in the art that the bottom gates 7 are lined in the same manner as in the entire wall structure 1. In accordance with the inventive concept the gates 7 are provided with sealing members 18 formed by horizontal panels 19 and an angle section 20 and having an inclined sealing surface A (FIG. 10) which, with the bottom gates in the closed position, contacts the surface of the girdle 6 tangentially and a sealing surface B which contacts the surface of the girdle 6 tangentially as well. The sealing members 18 are disposed above the level of the lining plates of the wall structure 1, which ensures a more dependable closing of the gates 7 and isolation of the sealing members 18 from the thermal effect of incandescent coke.

The bottom gates 7 are operated with the aid of linking members 21 hinge-connected to the bottom gates by means of hinge pins 22, the linking members 21 being in their turn hinge-connected to the pull rods 10 for lifting the whole apparatus to a quenching tower. The bottom gates 7 open by themselves after the apparatus of the invention has been placed by its supports 23 on pedestals (not shown) of the quenching tower.

In operation, the apparatus of the invention is loaded with incandescent coke. Heat causes the lining plates 2 to expand, but uncontrollable gaps remain therebetween; the gaps, however, exert no effect on the conditions of coke combustion, i.e. do not promote the latter, and hence the coke loss by burning is cut down as compared to the prior art. The air draught or inleakage is prevented owing to the provision of the cover pieces 13, while a free linear thermal expansion of the lining plates 2 is ensured due to a non-rigid fastening of the lining plates 2 by cover pieces 13 and to the provision of slots 24 at the edges of plates 2 and of holes 25 in the corrugated sheets 12. The corrugated sheet 12 prevents the heat transfer from incandescent coke to the wall structure 1 and also promotes the heat transfer from the lining to the ambient atmosphere, while the bottom gates 7, owing to the sealing members 18 abutting on the surfaces of revolution of the girdle 6, restrict the access of air into the hopper 5.

While the preferred embodiment of the present invention has been shown and described, various modifications may be made in the above-described arrangement without departing from the spirit and scope of the invention, as disclosed in the following examples.

Figure 4:
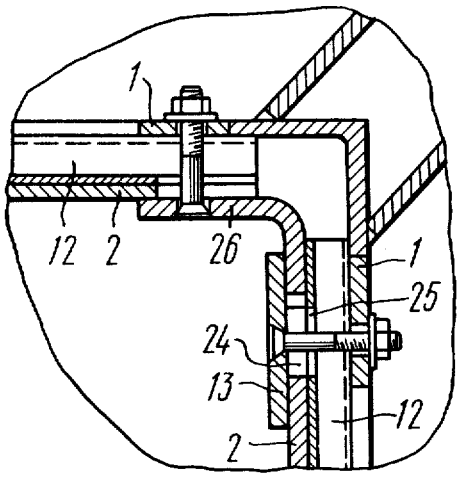
FIG. 4 is an enlarged horizontal sectional view of the angular assembly of the wall structure and lining plates.
Figure 5:
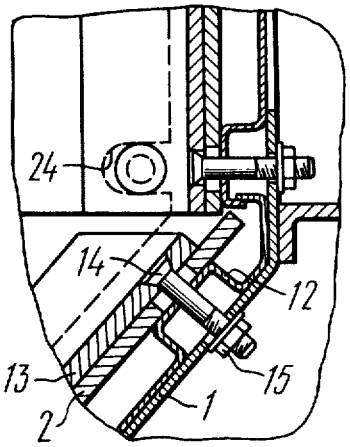
FIG. 5 is a vertical sectional view of the angular assembly of the wall structure and lining plates wherefrom the structure extends.
Figure 6:
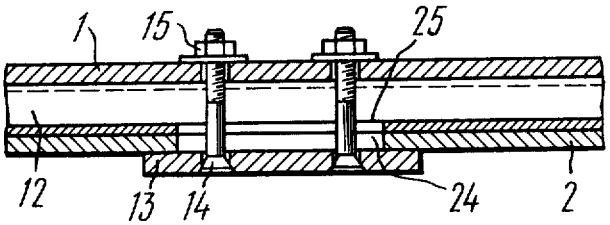
FIG. 6 is a sectional view taken along the line VI—VI in FIG. 1.

The lining plates 2 in the angular assembly of the apparatus of the invention are fastened by means of L-shaped cover pieces 26 and of the flat cover pieces 13, as shown in FIG. 4, while the lining plates 2 in the transitions of the wall structure 1 to the hopper 5 are arranged so that their edges overlap each other, as shown in FIG. 5. It will be clear to those skilled in the art that such modifications of the corner transitions may be mutually interchanged or that either one of the modifications may be employed for both corner transitions.

Figure 8:
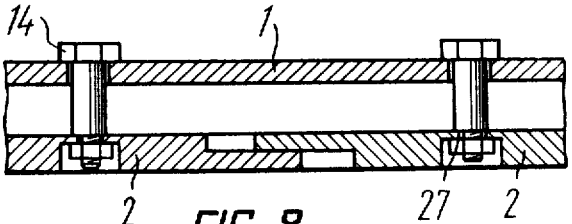
FIG. 8 is a view similar to that illustrated in FIG. 6, but representing an alternative assembly of the wall structure and lining plates.
Figure 7:
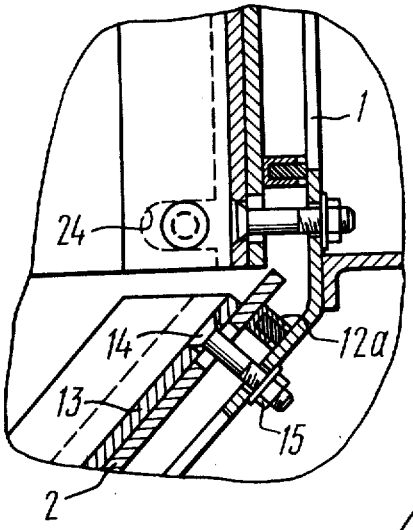
FIG 7 is a view similar to that illustrated in FIG. 5, but representing an alternative modification of the spacing member.

The fastening of the wall structure 1 and of the lining plate 2 may be accomplished with the use of a locking means comprising a spacing member made integral with the bolt 14 and having an end face or shoulder 27 whereon the lining plate 2 is supported, as shown in FIG. 8. A similar bolt, i.e. a member serving as both a fastener and a spacer, may be used in the modification of the fastening, shown in FIG. 6. Also, the spacing member may have the form of a bushing put on the bolt 14; this modification is not shown in the drawings, inasmuch as it will be apparent to those skilled in the art in the light of the above disclosure. The spacing member may also have a trough-shaped cross-section, e.g., such one as illustrated in FIG. 7 where a rolled U-section is shown. It will be seen in this Figure that a heat-resistant material, such as asbestos gaskets, may be employed in addition to the spacing member. Even the gaskets proper of such a material may be used as the spacing members.

Figure 9:
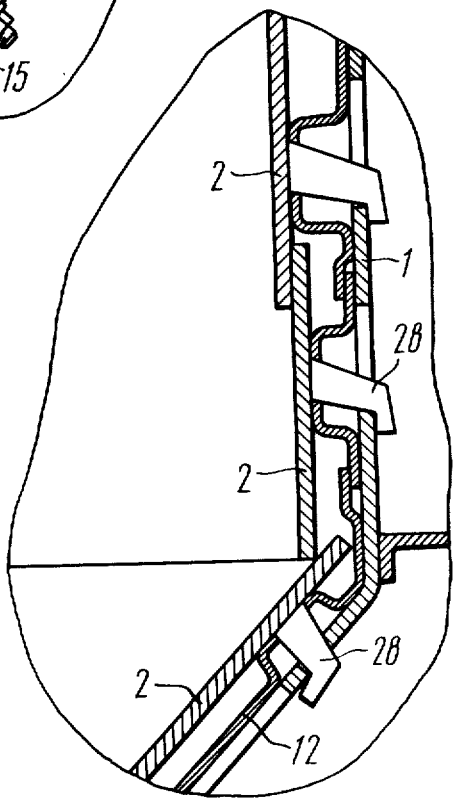
FIG. 9 is a view similar to that illustrated in FIG. 5, but representing a yet another assembly of the wall, structure and lining plates.
Figure 11:
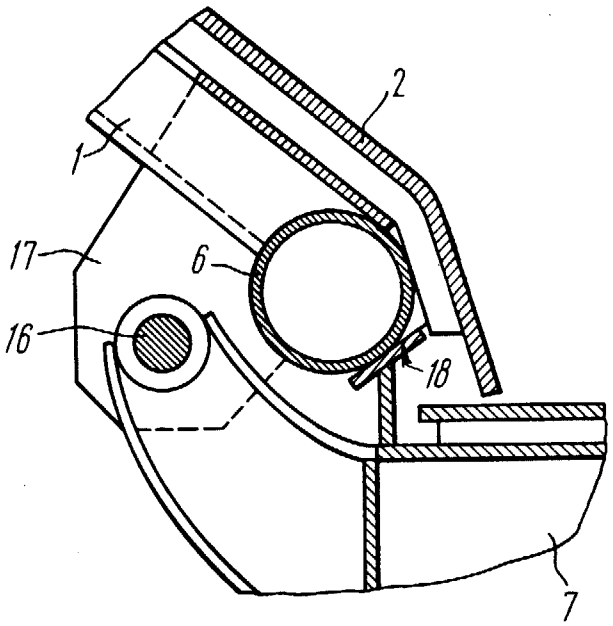
FIGS. 11, 12, and 13 are views similar to that illustrated in FIG. 10, but representing further embodiments of the invention.

FIG. 9 illustrates a still another alternative modification of the locking means, which is a hook 28 secured, as by welding, to the lining plate 2 and holding the plate in position with respect to the wall structure 1, the lining plates 2 being installed in an overlapping relationship. In this modification of the fastening, the predetermined gap between the wall structure 1 and the lining plates 2 is maintained with the use of the spacing members in the form of the corrugated sheets 12, although any other of the above-described and equivalent spacing members may be installed without contradicting the inventive concept.

The sealing member in accordance with the present invention may have either one flat sealing surface (FIG. 11), or one concave sealing surface whose radius of curvature somewhat exceeds that of the surface of the girdle 6 (FIG. 13), or a plurality of the sealing surfaces, such as three flat ones (FIG. 12), all such surfaces contacting the surface of the girdle 6 tangentially. It should also be noted that the cover pieces 13 are preferably made of the same material as are the lining plates 2.

INDUSTRIAL APPLICABILITY

The apparatus for receiving incandescent coke is used to best advantage at the coking plants where the dry coke-quenching technique is used.

We claim:

1. An apparatus for receiving incandescent coke and conveying the same from a coking chamber to a quenching site, comprising a wall structure which is lined with plates of a suitable material, installed so as to provide for a linear expansion thereof, and which defines at its bottom portion a hopper having a discharge hole, a girdle extending substantially circumferentially around the discharge hole, and bottom gates movable between an opened and closed position with respect to said discharge hole, characterized in that the wall structure and the lining plates are installed in a mutually spaced relationship to define a gap therebetween, the lining plates are joined with one another and with the wall structure by locking means and spacing members, the girdle being round in cross-section, and wherein the bottom gates are provided with sealing members which are fixed thereto for movement therewith, said sealing members having at least one sealing surface disposed so that, with the bottom gates in the closed position covering said discharge hole, said at least one sealing surface contacts said girdle extending tangentially with respect thereto.

2. An apparatus in accordance with claim 1, characterized in that each spacing member is a corrugated sheet.

3. An apparatus in accordance with claim 2, characterized in that the ends of the corrugated sheets overlap at the joints thereof.

4. An apparatus in accordance with the claim 1, characterized in that each spacing member is of a trough-shaped cross-section.

5. An apparatus in accordance with claim 1, characterized in that the lining plates are installed in a spaced relationship to define a gap therebetween and each locking means comprises a cover piece and a bolt holding said cover piece on the lining plates at the gap therebetween, passed between the adjacent lining plates, and locked against axial displacement by a nut.

6. An apparatus in accordance with claim 5, characterized in that said locking means and spacing members are combined and comprise a bolt having an end face or a shoulder whereon a lining plate is supported.

7. An apparatus in accordance with claim 1, characterized in that each locking means is a hook secured to the lining plate and holding said plate in the preset position with respect to the wall structure, the lining plates being installed in an overlapping relationship.

* * * * *